United States Patent [19]

Dantlgraber

[11] 4,132,506

[45] Jan. 2, 1979

[54] PRESSURE AND VOLUME-FLOW CONTROL FOR VARIABLE PUMP

[75] Inventor: Jorg Dantlgraber, Lohr, Fed. Rep. of Germany

[73] Assignee: G.L. Rexroth G.m.b.H., Lohr, Fed. Rep. of Germany

[21] Appl. No.: 741,460

[22] Filed: Nov. 12, 1976

[30] Foreign Application Priority Data

Nov. 14, 1975 [DE] Fed. Rep. of Germany ..... 2551088

[51] Int. Cl.[2] ..... F04B 49/00

[52] U.S. Cl. ..... 417/218; 60/450; 60/452; 417/53

[58] Field of Search ..... 417/218–222; 60/450, 452

[56] References Cited

U.S. PATENT DOCUMENTS

| | | | |
|---|---|---|---|
| 2,823,614 | 2/1958 | Lapsley | 417/220 |
| 2,865,397 | 12/1958 | Chenault | 137/501 X |
| 3,067,693 | 12/1962 | Lambeck | 417/219 |
| 3,623,321 | 11/1971 | Schwerin | 60/452 X |
| 3,635,021 | 1/1972 | McMillen et al. | 417/222 X |
| 4,035,105 | 7/1977 | Dantlgraber | 417/220 |

FOREIGN PATENT DOCUMENTS

| | | | |
|---|---|---|---|
| 2208877 | 9/1973 | Fed. Rep. of Germany | 417/221 |
| 2459550 | 7/1976 | Fed. Rep. of Germany | 417/221 |
| 1388002 | 3/1975 | United Kingdom | 417/220 |

*Primary Examiner*—Carlton R. Croyle
*Assistant Examiner*—Edward Look
*Attorney, Agent, or Firm*—Michael J. Striker

[57] ABSTRACT

A hydraulic system has a pump whose outlet is connected to a load and which has a pilot port whose pressurization is proportional to the pressure at the outlet. A restriction is provided between the outlet of the pump and the load. A differential valve is provided connected to the conduit between the pump and the load to both sides of the restriction and serves to compare the difference between pressure upstream and downstream of this restriction with a set point so as to depressurize the pilot port of the pump when this difference exceeds the set point. Furthermore, another valve is provided which compares the pressure in the feed conduit downstream of the restriction through yet another set point and also serves to depressurize the pilot port when this downstream pressure exceeds the second set point.

8 Claims, 1 Drawing Figure

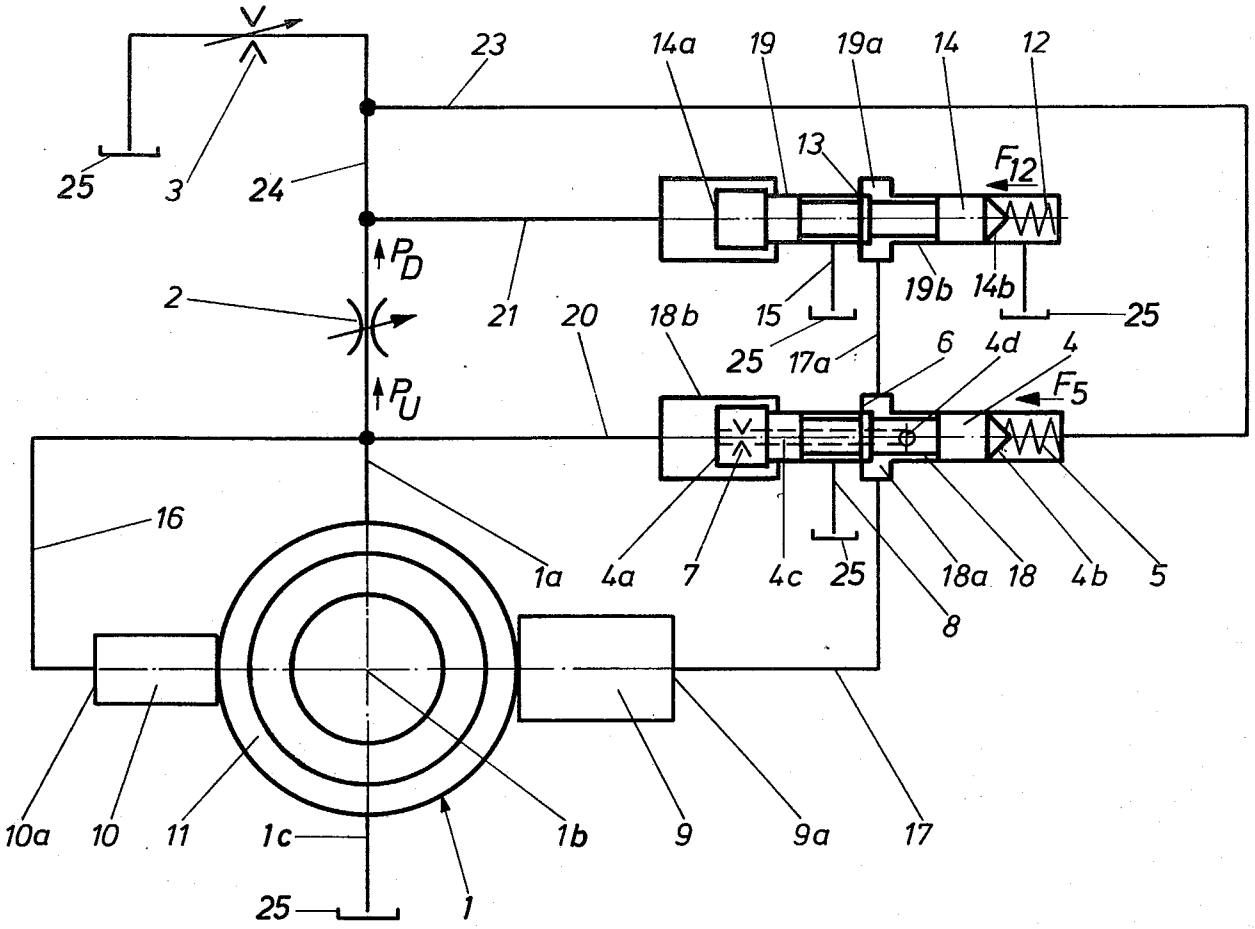
12
14
19a
19
14a
13
14b
19b
15
25
17a
6
4d
4
$F_{12}$
$F_5$
5
4b
18
18a
8
25
4c
7
4a
18b
20
21
23
$P_D$
$P_U$
24
3
2
16
1a
1b
1
1c
11
10
10a
9
9a
17

PRESSURE AND VOLUME-FLOW CONTROL FOR VARIABLE PUMP

BACKGROUND OF THE INVENTION

The present invention relates to a hydraulic system. More particularly this invention concerns the control of a hydraulic pump.

Hydraulic pumps are known having a pressurizable port and an outlet. The pump generates a pressure at its outlet which is generally proportional to the pressure at its control port. A typical such arrangement is a vane-type pump with a rotor that is radially displaceable by a pressurizable pilot cylinder, or an axial-piston pump whose swash plate can be tipped against the force of a spring or against the force of a hydraulic cylinder by means of a pilot cylinder.

When such devices are connected to a load it is known to control the pressure produced by the pump by means of simple overload devices which depressurize the pressurizable pilot port whenever the pressure in the outlet line exceeds a predetermined maximum. This ensures that if the load is jammed or the system stops for some reason the pump will not continue to pressurize the outlet line to the point where it could burst.

It has further been suggested to control such a pump by means of a volume sensor which detects the rate at which fluid flows through the outlet line and which depressurizes the pilot port of the pump when this rate exceeds a predetermined level. Such an arrangement is useful in that if the system springs a leak excessive fluid loss will be prevented.

The known systems have, however, the disadvantage that they are not able to respond fully to the various contingencies that can arise in a hydraulic system wherein the pump is connected to a load. Furthermore, they are frequently very complicated to adjust and are constituted by extremely complex mechanism which is highly failure-prone. What is more the known systems often are continuously adjusting or hunting so that the pump output is constantly varying, creating a strain on the entire system which can lead to its premature failure.

SUMMARY OF THE INVENTION

It is therefore an object of the present invention to provide an improved hydraulic system.

Another object is to provide an improved method of and apparatus for controlling a pump.

These objects are attained according to the present invention in a hydraulic system wherein a pump having a pressurizable control port and an outlet as described above is connected via a conduit to a load. According to this invention a restriction is provided in the conduit. Means is provided for determining the difference between the pressure in the conduit upstream and downstream of this restriction and for comparing it with a predetermined set point. If the difference between the upstream and downstream pressure exceeds the set point the control port of the pump is correspondingly depressurized. Furthermore the pressure downstream of the restriction is also compared all alone with a further set point and, when it exceeds this set point, the pressure at the control port is once again reduced.

This is achieved in accordance with the present invention by providing a pair of control valves. Each valve has a housing defining a chamber in which is reciprocal a valve body. The housing of each valve has a drain port and the valve body defines a compartment within the housing which can either be exposed to the drain port or separated from the drain port. This compartment is connected directly to the pressurizable control port of the pump so that when the valve body is moved into an open position exposing the drain port in the compartment this control port is depressurized. Each such valve comprises a respective spring which constitutes the respective set point.

As long as the valve is pressurized on one side of the valve body by the fluid upstream of the restriction and on the other side of the valve body by the fluid downstream of the restriction the pressure upstream of the restriction tends to urge the valve body in a direction toward the open position and the pressure downstream toward the closed position. The valve spring of this one valve also urges the valve toward the closed position.

The other valve in accordance with this invention has a connection to the feed conduit downstream of the restriction. This pressure downstream of the restriction is effective on the valve body to urge it into the open position solely against the force of a restoring spring.

Thus in accordance with this invention one of the valves responds purely to the pressure between the restriction and the load, forming part of an open-loop control. The other valve forms part of a closed-loop control since it is connected to both sides of this restriction. The second valve therefore measures the volumetric flow through the restriction since the pressure differential across this restriction will be proportional to flow through it.

In accordance with yet another feature of this invention at least one of the valve bodies is formed with a throughgoing passage in which is provided a valve restriction. This passage is preferably provided in the volume-control valve and opens on one side to that side of the body connected to the pressure upstream of the restriction in the feed line and on the other side to the compartment. Thus limited pressure can bleed through this passage and pressurize the control port.

In accordance with yet another feature of this invention the pump has two such control ports. The second control port is effective opposite to the first control port and is connected directly to the pump output. Thus a load balancing is achieved. The second control port connected directly to the pump output may be constituted by the inlet port of a small-diameter pilot cylinder, and the other pilot port is the inlet of a large-diameter pilot cylinder. Thus, with equal pressurization of these two ports the pump will be set for maximum pressure output.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

BRIEF DESCRIPTION OF THE DRAWING

The sole FIGURE of the drawing diagrammatically shows a hydraulic system operating according to the present invention.

SPECIFIC DESCRIPTION OF A PREFERRED EMBODIMENT

The system according to the present invention basically comprises a vane-type pump 1 having a rotor 1b radially displaceable in its chamber 11. This pump 1 has a high-pressure outlet 1a and a low-pressure inlet 1c, the latter being connected to a reservoir 25 and the former being connected via a conduit 24 to a load 3 whose other side is also connected to the reservoir 25. A pair of pilot cylinders 9 and 10, the former having a piston of a substantially larger effective surface area than the latter, are connected to the rotor 1b on diametrically opposite sides so that when the rotor 1b is displaced toward the left the pressure at 1a increases and vice versa.

There is provided in the feed conduit 24 between the outlet 1a and the load 3 a variable restriction 2. In addition a conduit 16 connects the pressure port 10a of the cylinder 10 directly to the outlet 1a. Thus there will be in the system a pressure $P_U$ upstream of the restriction 2 which will normally be greater than the pressure $P_D$ downstream of this restriction 2.

The pilot cylinder 9 has a pressurizable pilot port 9a connected via hydraulic conduit line 17 to a chamber 18a of a valve 18 having a spool-type valve member or piston 4. This valve 18 has a housing 18b in which the element 4 is displaceable toward the right as shown in the drawing. One side of the housing 18b is connected via a line 20 to the conduit 24 between the restriction 2 and the outlet 1a. Thus hydraulic fluid at a pressure $P_U$ will be effective against the one end face 4a of the piston 4. The other side of the housing is connected via a line 23 to the conduit 24 between the restriction 2 and load 3 for application of a fluid at pressure $P_D$ to the other face 4b of the valve body 4. In addition a variable compression spring 5 exerts a force $F_5$ on the valve-body face 4b in the same direction as the fluid of pressure $P_D$.

The housing 18b is also formed adjacent the chamber 18a with a drain port 8 connected to the low-pressure reservoir 25. A control surface 6 is displaceable on movement of the valve body 4 to the right so as to connect the compartment 18a to the drain port 8 and, therefore, depressurize the line 17.

Furthermore, the valve body 4 is formed with an axial bore 4c which opens at the face 4a and with a connecting radial bore 4d which opens in the compartment 18a. A restriction 7 is provided in the bore 4c so that limited amounts of fluid can flow from the conduit 20 through the passage 4c, 4d to the chamber 18a and thence through the line 17 to the pilot port 9a.

Thus this valve 18 will serve to depressurize the port 9a when fluid flow through the restriction 2 exceeds a predetermined volumetric maximum. This port 9a will be depressurized when the pressure $P_U$ is greater than the pressure $P_D$ plus the force $F_5$. So long as the differential between the pressures $P_U$ and $P_D$ is smaller than the force $F_5$ the piston 4 will lie in the illustrated position and the chamber 18a will be pressurized through the passage 4c, 4d. In this position the port 9a will therefore receive the pressure $P_U$ as will the port 10a. Since the cylinder 9 is of larger diameter than the cylinder 10 this will force the rotor 1b all the way to the left and maximize the pressure $P_U$.

When, however, the differential between the pressures $P_U$ and $P_D$ is larger than the force $F_5$ the valve body 4 will move to the right and allow the chamber 18a to drain through the port 8. This will decrease pressurization at the port 9a and shift the rotor 1b toward the right, thereby decreasing the pressure at the output 1a. Under normal circumstances the piston 4 will assume a position allowing limited leakage from the chamber 18a past the surface 6 into the port 8 so as to maintain the port 9a under a pressure exactly necessary to maintain a predetermined volumetric flow through the restriction 2.

In addition the system is provided with a valve 19 having a housing 19b of identical shape to the housing 18b and provided with a valve body 14 substantially identical to the valve body 4 but not provided with the passage 4c, 4d. The one side of the housing 19b is connected via a line 21 to the conduit 24 between the restriction 2 and the load 3 so that fluid at pressure $P_D$ is effective on the face 14a of the body 14. A spring 12 bears with a force $F_{12}$ on the opposite face 14b of the valve body 14. This valve 19 further has a chamber 19a connected via a conduit 17a to the chamber 18a and therethrough to the pilot port 9a. The chamber formed to the right of the valve body 14 is connected to the reservoir 25. Furthermore, the valve body 14 has control surface 13 which allow the chamber 19a to be connected to a drain pipe 15 identical to the drain port 8.

This second valve 19 serves to depressurize the lines 17a and 17 as well as the port 9a when the pressure $P_D$ is greater than the force $F_{12}$. Thus the valve 19 serves to depressurize the port 9a whenever the pressure $P_D$ exceeds a predetermined set-point value. Once again the valve body 14 in practice will often assume a position allowing limited leakage from the chamber 19a to the drain port 15 for even control of pressure in the line 24.

It is understood in the above discussion that the actual forces exerted on the surface 4a, 4b, and 14a by fluid are in reality equal to the product of the pressures $P_D$ or $P_U$ times the surface areas of these surfaces. On the other hand, the forces $F_5$ and $F_{12}$ are normally constant. In the illustrated arrangement effective surface areas 4a, 4b, and 14a are all identical.

Thus if with the present system the volumetric flow through the restriction 2 rises above a predetermined value, the valve 18 will reduce the pressure at the outlet 1a. This prevents the system from burning itself out in case, for instance, a leak occurs upstream of the load 3. Similarly, if the load 3 becomes jammed the pressure $P_D$ will rise precipitously. The volumetric flow through the restriction 2 will not increase so that the valve 18 will not respond but the valve 19 will quickly respond to drain the conduit 17 and reduce the pressure at the outlet 1a. Such an arrangement insures quick control of the hydraulic system under all circumstances.

It is noted with respect to the above that the various pressures can be converted into other units, as for example by means of piezoelectric transducers so that valves 18 and 19 can be made to respond magnetically or otherwise. Such conversion of the pressures into signals is entirely within the scope of this invention, as is the similar electrical or pneumatic actuation of the pump 1.

It will be understood that each of the elements described above, or two or more together, may also find a useful application in other types of hydraulic systems differing from the types described above.

While the invention has been illustrated and described as embodied in a pump control arrangement, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims;

1. A method of controlling a source of fluid pressure having an output connected via a fluid path to a load and having a control port whose pressurization determines and is generally proportional to the pressure at said output, said method comprising the steps of:

(a) restricting flow at a location along said path;

(b) substantially continuously returning some of said fluid from said path through a restriction to said control port and pressurizing same therewith;

(c) sensing pressure in said path upstream of said location and generating an upstream pressure signal corresponding thereto;

(d) sensing pressure in said path between said location and said load and generating a downstream pressure signal corresponding thereto;

(e) comparing said upstream and downstream signals and generating a difference signal corresponding to the difference therebetween;

(f) comparing said difference signal with a predetermined first set point and depressurizing said control port at least partially when said difference signal exceeds said first set point; and (g) comparing said downstream signal with a second set point and depressurizing said control port at least partially when said downstream signal exceeds said second set point.

2. The method defined in claim 1 wherein said upstream and downstream signals are compared by applying the pressures upstream and downstream of said location to opposite sides of a valve body.

3. The method defined in claim 2 wherein the difference signal of step (f) is constituted by a unidirectional force in said valve body, said set point being a spring force exerted on said body in a direction opposite the application of said upstream pressure.

4. The method defined in claim 1 wherein said downstream signal and said second set point are compared by applying the pressure downstream of said restriction to one side of a displacable valve body and by applying a generally constant spring force in the opposite direction to the other side of said body.

5. A hydraulic system comprising:

pump means having a pressurizable control port and an outlet for generating at said outlet a fluid pressure generally proportional to the pressure at said control port;

a load;

a conduit connecting said outlet to said load, whereby said load can be operated by said pump through said conduit;

a main restriction in said conduit;

means forming a flow path from said outlet to said control port and including a secondary restriction in said flow path for substantially continuously feeding fluid from said outlet to said control port;

means including two control valves each having a housing formed with a chamber and with a drain port, a valve body in said chamber and forming a compartment, said body being displaceable in said chamber between an open position exposing the respective drain port to the respective compartment and a closed position isolating the respective drain port from the respective compartment, and a spring urging the respective body into the respective closed position;

means interconnecting said conduit to both sides of said main restriction to one of said valves for applying the pressure upstream of said main restriction to the respective valve body in a direction urging same into said open position and for applying the pressure downstream of said main restriction to the respective valve body in a direction urging same into said closed position;

means interconnecting said conduit between said main restriction and said load to the other valve for applying the pressure downstream of said main restriction to the respective valve body in a direction urging same into said open position; and means connecting said compartments together to said control port.

6. The system defined in claim 5 wherein said pump means has a means including a relatively large diameter pilot cylinder pressurizable for increasing the throughput of said pump means and having said control port and means including a relatively small diameter pilot cylinder oppositely effective and pressurizable for reducing the throughput of said pump means, said system further comprising a line interconnecting said small diameter pilot cylinder directly to said output for pressurization of said small diameter cylinder with the upstream pressure.

7. A hydraulic system comprising:

pump means having a pressurizable control port and an outlet for generating at said outlet a fluid pressure generally proportional to the pressure at said control port;

a load;

a conduit connecting said outlet to said load, whereby said load can be operated by said pump through said conduit;

a restriction in said conduit;

means including two control valves each having a housing formed with a chamber and with a drain port, a valve body in said chamber and forming a compartment, said body being displaceable in said chamber between an open position exposing the respective drain to the respective compartment and a closed position isolating the the respective drain from the respective compartment, and a spring urging the respective body into said closed position;

means connecting said conduit to both sides of said restriction to one of said valves for applying the pressure upstream of said restriction to the respective valve body in a direction urging same into said open position and for applying the pressure downstream of said restriction to the respective valve body in a direction urging same into said closed position, said valve body of said one valve being formed with a throughgoing passage opening at one end at the side exposed to the upstream pressure and at the other side into the respective compartment, said passage being provided with a restriction;

means connecting said conduit between said restriction of said conduit and said load to the other valve for applying the pressure downstream of said restriction of said conduit to the respective valve body in a direction urging same into said open position; and means connecting said compartments together to said control port.

8. The system defined in claim 7 wherein both of said valve bodies are spools.

* * * * *